US005799558A

United States Patent [19]

Hewitt et al.

[11] Patent Number: 5,799,558

[45] Date of Patent: Sep. 1, 1998

[54] ARBOR AND CIRCULAR SAW WITH ASYMMETRIC SPLINE HAVING GENERALLY RADIAL FORCE-TRANSMITTING FACE

[75] Inventors: Keith H. Hewitt, Sandy, Oreg.; Douglas Darrell Miller, Shreveport; Steve Bryant Wilson, Vivian, both of La.

[73] Assignees: Pacific Saw and Knife Company, Portland, Oreg.; Precision Tool & Die Corporation Of Shreveport, Inc., Shreveport, La.

[21] Appl. No.: 899,395

[22] Filed: Jul. 23, 1997

Related U.S. Application Data

[63] Continuation of Ser. No. 614,198, Mar. 6, 1996, abandoned.

[51] Int. Cl.[6] ..... B26D 1/12

[52] U.S. Cl. ..... 183/665; 83/698.41; 30/388

[58] Field of Search ..... 83/664, 665, 666, 83/698.41, 835; 403/359; 30/388; 125/15

[56] References Cited

U.S. PATENT DOCUMENTS

| | | | |
|---|---|---|---|
| Re. 27,126 | 5/1971 | Gingery | 403/359 X |
| 611,556 | 9/1898 | Blanton, Jr. | 403/359 X |
| 2,479,698 | 8/1949 | Paquin | 403/359 X |
| 2,912,021 | 11/1959 | Gommel | 83/665 |
| 3,222,772 | 12/1965 | Leyner | 403/359 X |
| 3,415,153 | 12/1968 | Steiner | 403/359 X |
| 3,440,915 | 4/1969 | Weyant | 83/666 |
| 3,516,460 | 6/1970 | Thrasher | 83/665 X |
| 3,619,882 | 11/1971 | Sobanski et al. | 83/666 X |
| 3,703,915 | 11/1972 | Pearson | 83/676 X |
| 4,153,260 | 5/1979 | Joyner | 403/359 X |
| 4,318,306 | 3/1982 | Fischer | 403/359 X |
| 4,572,291 | 2/1986 | Robison | 403/359 X |
| 4,657,428 | 4/1987 | Wiley | 83/666 X |
| 4,685,823 | 8/1987 | Lopez | 403/359 |
| 4,730,952 | 3/1988 | Wiley | 83/665 X |
| 4,747,607 | 5/1988 | Emter | 279/133 |
| 4,827,800 | 5/1989 | Pedersen et al. | 403/359 X |
| 4,987,330 | 1/1991 | Murphy et al. | 310/217 |
| 5,311,664 | 5/1994 | Abdul | 30/276 |

FOREIGN PATENT DOCUMENTS

| | | | |
|---|---|---|---|
| 1015246 | 8/1977 | Canada . | |
| 5-38621 | 2/1993 | Japan | 83/835 |
| WO93/19907 | 10/1993 | WIPO . | |

*Primary Examiner*—Maurina T. Rachuba
*Attorney, Agent, or Firm*—Klarquist Sparkman Campbell Leigh & Whinston, LLP

[57] ABSTRACT

An arbor is formed with uniformly-spaced splines each of which has a cross-section in the shape of an asymmetric trapezoid. The leading force transmitting face of each of the splines is disposed at an angle lagging by about seven degrees from a truly radially-extending plane of the arbor. The trailing face of each of the splines is disposed other than in a generally radially-extending plane of the arbor. A circular saw blade mounted on the arbor has a central opening or eye formed with complementarily shaped recesses such that the arbor splines fit within the recesses in the eye for transmission of torque from arbor to saw.

2 Claims, 2 Drawing Sheets

ARBOR AND CIRCULAR SAW WITH ASYMMETRIC SPLINE HAVING GENERALLY RADIAL FORCE-TRANSMITTING FACE

This application is a continuation of Application No. 08/614,198, filed Mar. 6, 1996, now abandoned.

FIELD OF THE INVENTION

This invention relates to the mounting of circular saws and, more particularly, to an improved means for the mounting of such saws on a splined arbor.

BACKGROUND OF THE INVENTION

Thrasher, U.S. Pat. 3,516,460, discloses the mounting of a circular saw on an arbor, wherein the saw blade itself is formed with a scalloped opening to allow the saw to be mounted on the arbor without the necessity of using a saw collar. The mounting provides axial floating looseness, yet achieves a positive drive connection capable of withstanding the shear forces normally experienced during cutting.

The Thrasher arbor has a plurality of splines arranged circumferentially therearound in a symmetrical pattern. The saw has a central opening, or eye, which has a plurality of recesses complementary to the arbor periphery. Each arbor spline has a sloped surface relative to a diameter through its geometric center. This type of surface has generally been provided either by a rounded, i.e., semi-circular, spline, or by a spline having a "tooth-like" surface. The sloped surface tends to center the saw upon the arbor by virtue of the symmetrical contacts which the opening in the saw makes with the sloped surfaces of each spline.

Emter, U.S. Pat. No. 4,747,607, discloses a saw blade similar to the Thrasher blade wherein the scallops were specifically described as semi-circular. Indeed semi-circular arbor splines and saw blades with complementary semi-circular recesses have become standard in the industry.

Transmission of torque by an arbor having semi-circular splines to a circular saw blade having complementary semi-circular recesses, however, has been found to result in line contact at the leading faces of the splines. This causes rapid wear on the eye of the saw. Unacceptable wear also occurs when the spline is generally tooth-like.

Also, where the arbor splines and saw blade recesses are symmetrical, an operator can inadvertently mount a saw on an arbor backwards, thereby to result in the saw hitting the workpiece with the back of its teeth.

It is thus the primary object of the present invention to provide a splined arbor and a circular saw for mounting thereon wherein the splines have cross-sections that will avoid line contact at the torque transmitting interfaces. Such will result in improved power transmission and less wear on the eye of the saw.

It is a further object of the present invention to provide such an arbor and saw wherein the saw cannot be mounted backwards on the arbor.

These and other objects of the invention are achieved by providing an arbor with splines having cross-sections in the shape of an asymmetric trapezoid and wherein the leading face of each spline is disposed in a generally radially-extending plane with respect to the arbor. A generally radial leading spline face provides excellent force transmission, yet avoids the problems associated with line contact that have been heretofore experienced.

Furthermore, inasmuch as the spline cross-section is that of an asymmetric trapezoid, i.e., the trailing spline face is not radial, the saw blade cannot be mounted on the arbor backwards. Stated otherwise, the saw blade can be mounted on the arbor only in a manner wherein the leading force transmitting faces of the splines are in contact with the leading force receiving faces of the recesses in the saw blade eye.

A preferred embodiment has been found to be one wherein the leading force transmitting faces of the arbor splines and the leading force receiving faces of the recesses in the eye or central opening of the saw are each disposed at a face angle lagging by about seven degrees from the respective radially-extending planes of the arbor and saw blade.

DESCRIPTION OF A PREFERRED EMBODIMENT

Figure 1:
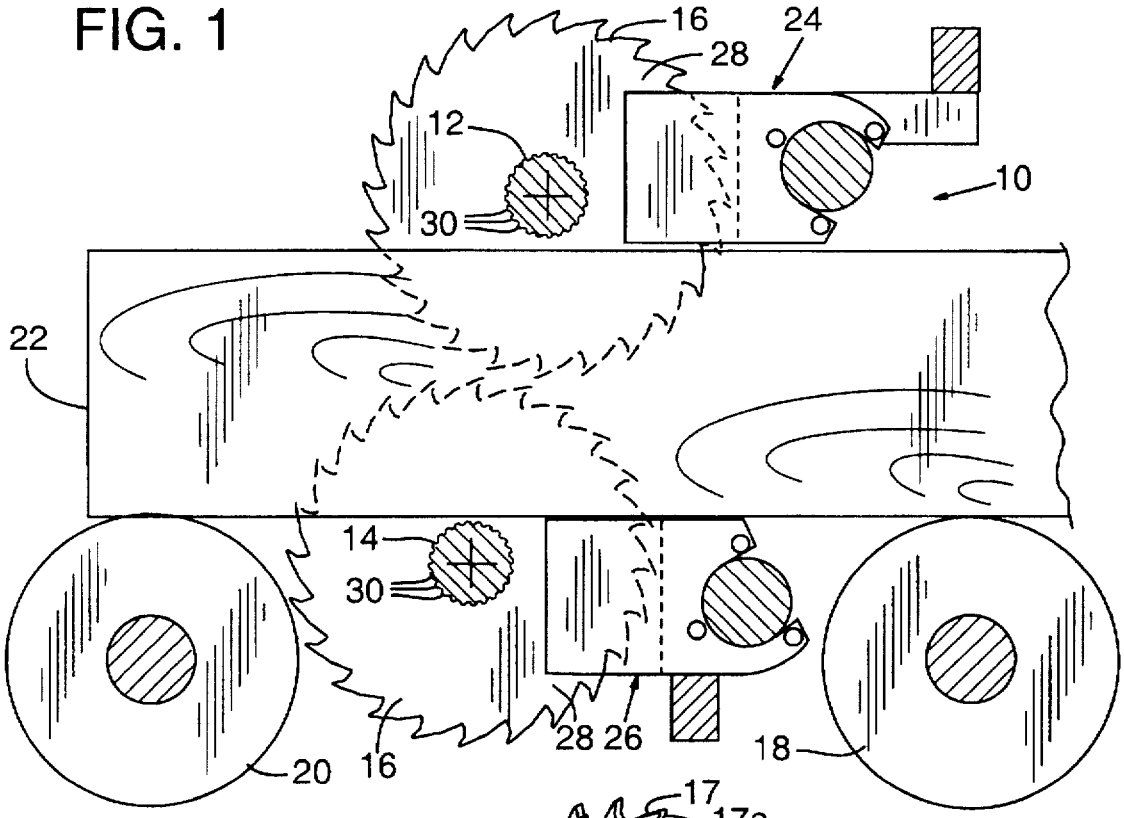
FIG. 1 is an elevational and partial vertical sectional view taken through a double arbor battery edger having saw guiding apparatus and a plurality of circular saws mounted on the arbors, the arbors and saws having splines and recesses in accordance with the present invention.
Figure 2:
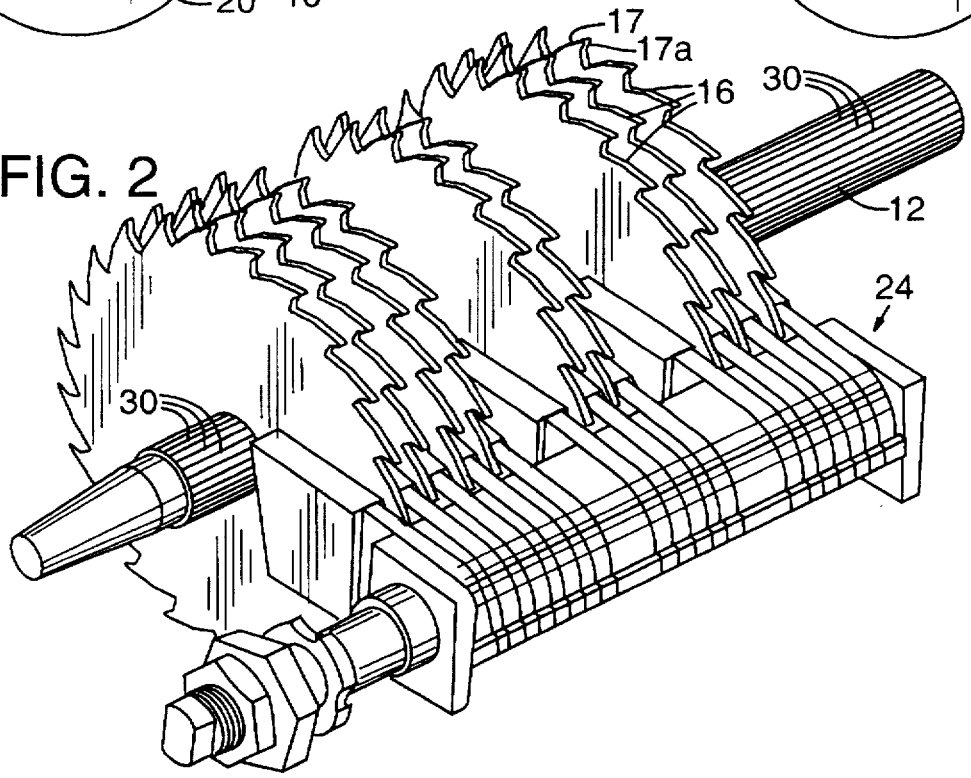
FIG. 2 is a perspective view of one of the arbors of FIG. 1 with its associated saws and saw guiding apparatus.

Referring to the drawings, in FIG. 1 there is shown, by way of illustration, a double arbor battery edger 10, comprised of upper and lower arbors 12, 14, each arbor supporting a plurality of circular saws 16 having a plurality of conventional cutting teeth 17 with cutting edges 17*a* as shown in FIG. 2. A pair of rollers 18, 20 form a part of a conventional apparatus for moving a cant 22 into the battery of saws 16 for conveying the lumber through and past the blades. Upper and lower saw guides 24, 26, respectively, engage the leading sides 28 of saws 16, as shown.

Figure 3:
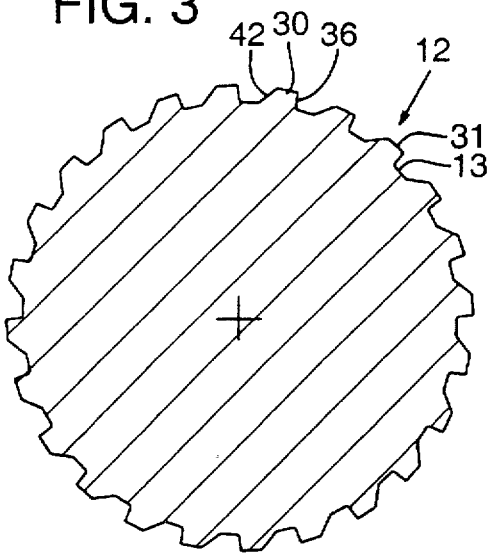
FIG. 3 is a cross-sectional view to an enlarged scale of one of the arbors of FIG. 1, illustrating the splines of the invention.
Figure 4:
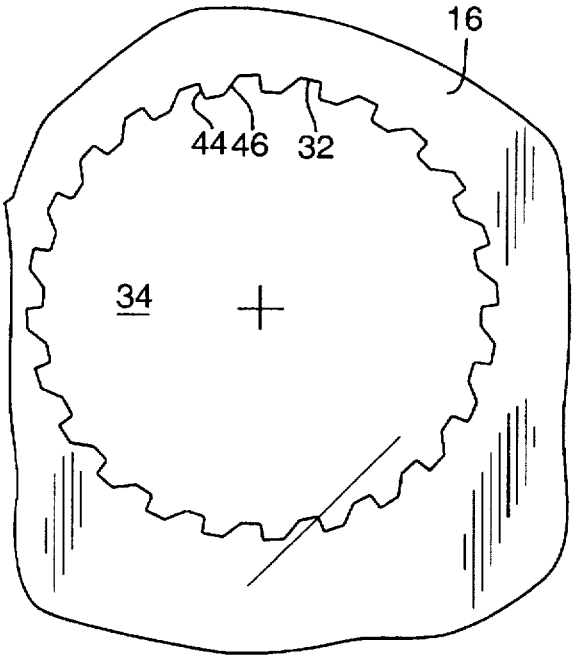
FIG. 4 is a partial elevational view to the same scale as FIG. 3 of one of the saws mounted on the arbor of FIG. 3.

This invention is more particularly directed to the shape of the splines 30 on arbors 12, 14, as well as the shape of the complementary recesses 32 formed in the central opening or eye 34 of saws 16. See FIGS. 3, 4, and 5.

Figure 5:
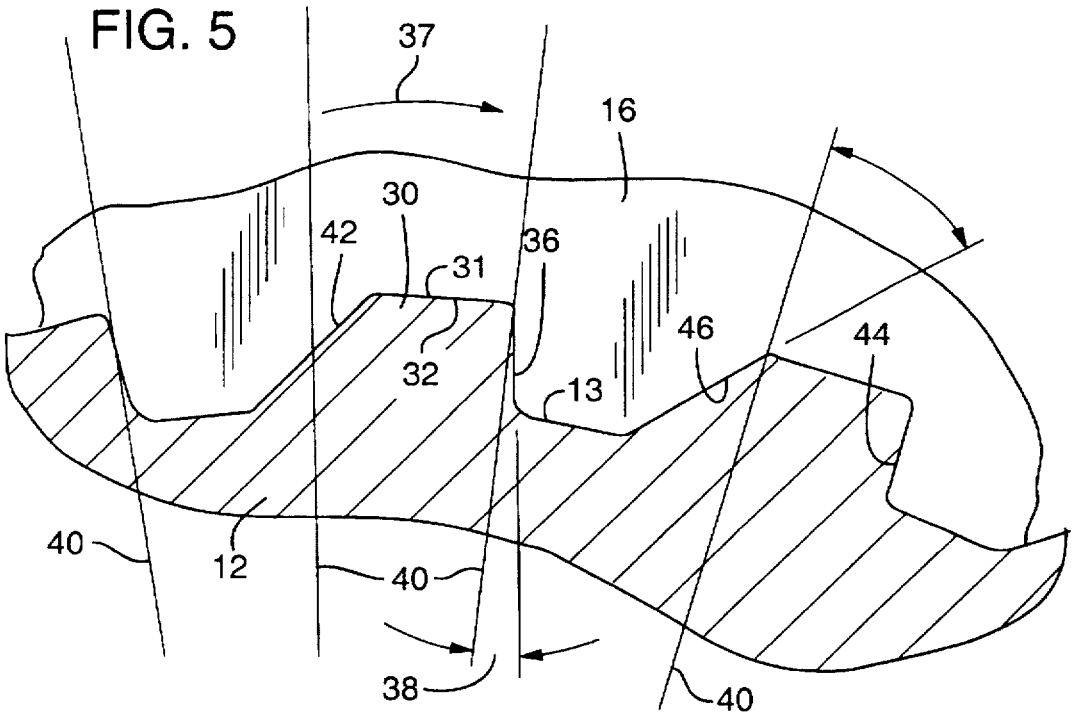
FIG. 5 is a greatly enlarged partial elevational and sectional view illustrating the saw of FIG. 4 mounted on the arbor of FIG. 3.

As most clearly shown in FIG. 5, each spline 30 has a cross-section in the shape of an asymmetric trapezoid. Spline 30 has an exterior surface 31 extending generally parallel to the exterior surface 13 of arbor 12, a leading force transmitting face 36 (rotation of arbor 12 and saw 16 is in the direction of the arrow 37) disposed at a slight angle 38, which lags with respect to a truly radially-extending plane 40 of arbor 12, and a trailing face 42 disposed other than in a radially-extending plane, such that the resulting cross-section of spline 30 is indeed that of an asymmetric trapezoid. Splines 30 and, of course, recesses 32 are disposed or spaced in a uniform symmetrical pattern circumferentially around the peripheries of arbor 12 and opening 34, respectively.

Preferably, face 36 is formed at a face angle 38 which lags by about seven degrees from the truly or precisely radially-extending plane 40 that is, face 36 intersects the exterior surface 31 of spline 30 at an angle of about 97 degrees. See FIG. 5. Thus, face 36 can be described as being disposed in a "generally" radially-extending plane of the arbor. Face 36 so located permits spline 30 to achieve excellent force transmission, avoids the problems heretofore experienced associated with line contact, and also achieves the requisite self-centering effect when saw 16 is under load. Trailing face 42 preferably intersects the exterior surface 31 of spline 30 at an angle of about 135 degrees. Again, see FIG. 5.

Correspondingly, recesses 32 in central opening 34 of saw 16 are, of course, each formed in a shape having a cross-section complementary to that of the respective spline 30; that is, each recess 32 is also formed with a cross-section in the shape of an asymmetric trapezoid. Each recess 32 has a leading force receiving face or side 44 disposed in the corresponding generally radially-extending plane of saw 16 and a trailing face 46, which is disposed other than in a generally radially-extending plane of the saw.

As with splines 30, each force receiving face 44of saw 16 is disposed at a face angle 38, which also lags by about seven degrees from the precisely radially-extending planes 40. Of course, as is conventional, the cutting edge 17a of each tooth 17 of saw 16 faces in the same direction as the direction of rotation 37 of the leading force transmitting face 36 of a corresponding adjacent spline 30.

Inasmuch as the respective cross-sections of splines 30 and recesses 32 are each those of an asymmetric trapezoid, it is impossible to mount a saw 16on an arbor 12 backwards.

Although a preferred embodiment of our invention has been illustrated and described, modifications and changes may be made without departing from the spirit and true scope of the invention, therefore each of such modifications and changes is contemplated.

We claim:

1. In combination, an arbor (12) and a circular saw blade (16) mounted for rotation on the arbor (12) in a selected direction (37), the arbor (12) comprising an exterior surface (13) and at least one longitudinally-oriented spline (30) disposed on the exterior surface (13) of the arbor (12), the spline (30) comprising:

an exterior surface (31) extending generally co-axially with the arbor (12), a leading force-transmitting face (36) intersecting the exterior surface (31) of the spline (30) at an angle of about ninety-seven degrees, the leading force-transmitting face (36) facing in the selected direction (37), and a trailing face (42) intersecting the exterior surface (31) of the spline (30) at an angle of about one hundred thirty-five degrees;

the circular saw blade (16) comprising:

a plurality of cutting teeth (17) having cutting edges (17*a*) facing in the selected direction (37), and a central opening (34) comprising at least one longitudinally-oriented recess (32) having a shape complementary to the spline (30) of the arbor (12) and closely fitting therewith, the recess (32) comprising a leading force-receiving side (44) disposed in the selected direction, the saw blade (16) being mounted on the arbor (12) with the force-transmitting face (36) of the spline (30) in contact with the force-receiving side (44) of the recess (32) to transmit torque to the force-receiving side (44) of the recess (32) and drive the saw blade (16) in the selected direction (37), whereby the saw blade (16) can be mounted on the arbor (12) only for rotation in the selected direction.

2. The combination of claim 1, wherein the at least one longitudinally-oriented spline (30) comprises a plurality of splines (30) and the at least one longitudinally-oriented recess (32) comprises a plurality of recesses (32), the splines (30) and the recesses (32) being disposed in a uniformly-spaced symmetrical pattern circumferentially around the arbor (30) and the opening (34), respectively.

* * * * *

UNITED STATES PATENT AND TRADEMARK OFFICE

CERTIFICATE OF CORRECTION

PATENT NO. : 5,799,558
APPLICATION NO. : 08/899395
DATED : September 1, 1998
INVENTOR(S) : Hewitt et al.

It is certified that error appears in the above-identified patent and that said Letters Patent is hereby corrected as shown below:

Column 2, line 67, “40 that is,” should be --40; that is,--;
Column 3, line 19, “44of” should be --44 of--;
Column 3, line 29, “16on” should be --16 on--.

Signed and Sealed this

Fifteenth Day of January, 2008

JON W. DUDAS
*Director of the United States Patent and Trademark Office*